US008037708B2

(12) United States Patent
Cho et al.

(10) Patent No.: US 8,037,708 B2
(45) Date of Patent: Oct. 18, 2011

(54) REFRIGERATOR AND METHOD OF MANUFACTURING THE SAME

(75) Inventors: Nam Soo Cho, Seoul (KR); Youn Seok Lee, Seoul (KR); Kyeong Yun Kim, Seoul (KR); Su Nam Chae, Seoul (KR); Sang Oh Kim, Seoul (KR); Jang Seok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 645 days.

(21) Appl. No.: 12/167,058

(22) Filed: Jul. 2, 2008

(65) Prior Publication Data

US 2009/0013710 A1 Jan. 15, 2009

(30) Foreign Application Priority Data

Jul. 11, 2007 (KR) ..... 10-2007-0069742

(51) Int. Cl.
*F25D 21/14* (2006.01)

(52) U.S. Cl. ..... 62/285; 62/291

(58) Field of Classification Search ..... 62/285, 62/443, 441, 447, 291, 289; 29/890.035
See application file for complete search history.

(56) References Cited

U.S. PATENT DOCUMENTS

| | | | | |
|---|---|---|---|---|
| 2,943,455 | A | | 7/1960 | Reverman, Jr. |
| 3,674,359 | A | | 7/1972 | Crowe |
| 4,067,628 | A | | 1/1978 | Sherburn |
| 4,296,611 | A | * | 10/1981 | Griffin et al. ..... 62/89 |
| 4,330,310 | A | | 5/1982 | Tate, Jr. et al. |
| 4,722,200 | A | * | 2/1988 | Frohbieter ..... 62/382 |
| 5,159,973 | A | * | 11/1992 | Pennington et al. ..... 165/48.1 |
| 5,168,621 | A | | 12/1992 | Kruck et al. |
| 5,285,655 | A | * | 2/1994 | Sung-Il et al. ..... 62/451 |
| 5,347,820 | A | * | 9/1994 | In Gweon ..... 62/78 |
| 5,501,084 | A | * | 3/1996 | Chang et al. ..... 62/264 |
| 5,732,561 | A | * | 3/1998 | Kim ..... 62/89 |
| 5,787,725 | A | * | 8/1998 | Shin ..... 62/443 |
| 5,867,994 | A | * | 2/1999 | Kopko ..... 62/82 |
| 5,881,568 | A | * | 3/1999 | Kim ..... 62/443 |
| 6,209,342 | B1 | * | 4/2001 | Banicevic et al. ..... 62/443 |
| 6,223,553 | B1 | * | 5/2001 | Albert et al. ..... 62/407 |
| 6,474,094 | B2 | * | 11/2002 | Kim ..... 62/441 |
| 6,742,353 | B2 | * | 6/2004 | Ohashi et al. ..... 62/443 |
| 6,837,067 | B2 | * | 1/2005 | Lee ..... 62/441 |
| 2005/0034419 | A1 | | 2/2005 | Randall, Sr. et al. |

FOREIGN PATENT DOCUMENTS

| | | | |
|---|---|---|---|
| AU | 2003270945 | A1 | 7/2004 |
| GB | 1 394 946 | A | 5/1975 |

* cited by examiner

*Primary Examiner* — Mohammad Ali
(74) *Attorney, Agent, or Firm* — Birch, Stewart, Kolasch & Birch, LLP

(57) ABSTRACT

A refrigerator and a method for manufacturing the same. The refrigerator includes a main body which has a specified space and a open front surface, and a plate having a specified thickness, in which the plate is inserted into the main body through one side of the open front surface of the main body to sectionalize the space provided in the main body.

13 Claims, 4 Drawing Sheets

REFRIGERATOR AND METHOD OF MANUFACTURING THE SAME

CROSS-REFERENCE TO RELATED APPLICATION

This application claims the benefit of Korean Patent Application No. KR 10-2007-0069742, filed on Jul. 11, 2007, which is hereby incorporated by reference in its fully set forth herein.

BACKGROUND OF THE INVENTION

1. Field of the Invention

The present invention relates to a refrigerator and a method for manufacturing the same, and more particularly to a refrigerator having a novel type cooling chamber structure and a method for manufacturing the same.

2. Discussion of the Related Art

Generally, a refrigerator is a machine which cools food or the like to store food for a long period of time. The refrigerator uses a phase transition phenomenon of a coolant through a compressor, condenser, an expansion device and an evaporator to maintain a cooling chamber at a low temperature.

Side-by-side refrigerators have commercial advantages. New methods of cooling side-by-side refrigerators are being developed. However, it is very difficult to manufacture a refrigerator having a new type cooling chamber structure by a related art method for manufacturing a refrigerator.

SUMMARY OF THE INVENTION

Accordingly, one object of the present invention is to provide a refrigerator and a method for manufacturing the same that substantially obviate one or more problems due to limitations and disadvantages of the related art.

An other object of the present invention is to provide a refrigerator having a novel type cooling chamber structure and a method for manufacturing the same to facilitate the manufacture of a cooling chamber structure having a complicated shape.

To achieve these objects and other advantages and in accordance with the purpose of the invention, as embodied and broadly described herein, the present invention provides in one aspect a method for manufacturing a refrigerator that includes manufacturing a main body which has a specified space and a open front surface, manufacturing a plate having a specified thickness, and inserting the plate into the main body through one side of the open front surface of the main body to sectionalize the space provided in the main body.

In another aspect, the present invention provides a refrigerator including a main body enclosing an inner space, and a plate inserted into the main body to divide the inner space into a plurality of cooling chambers.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
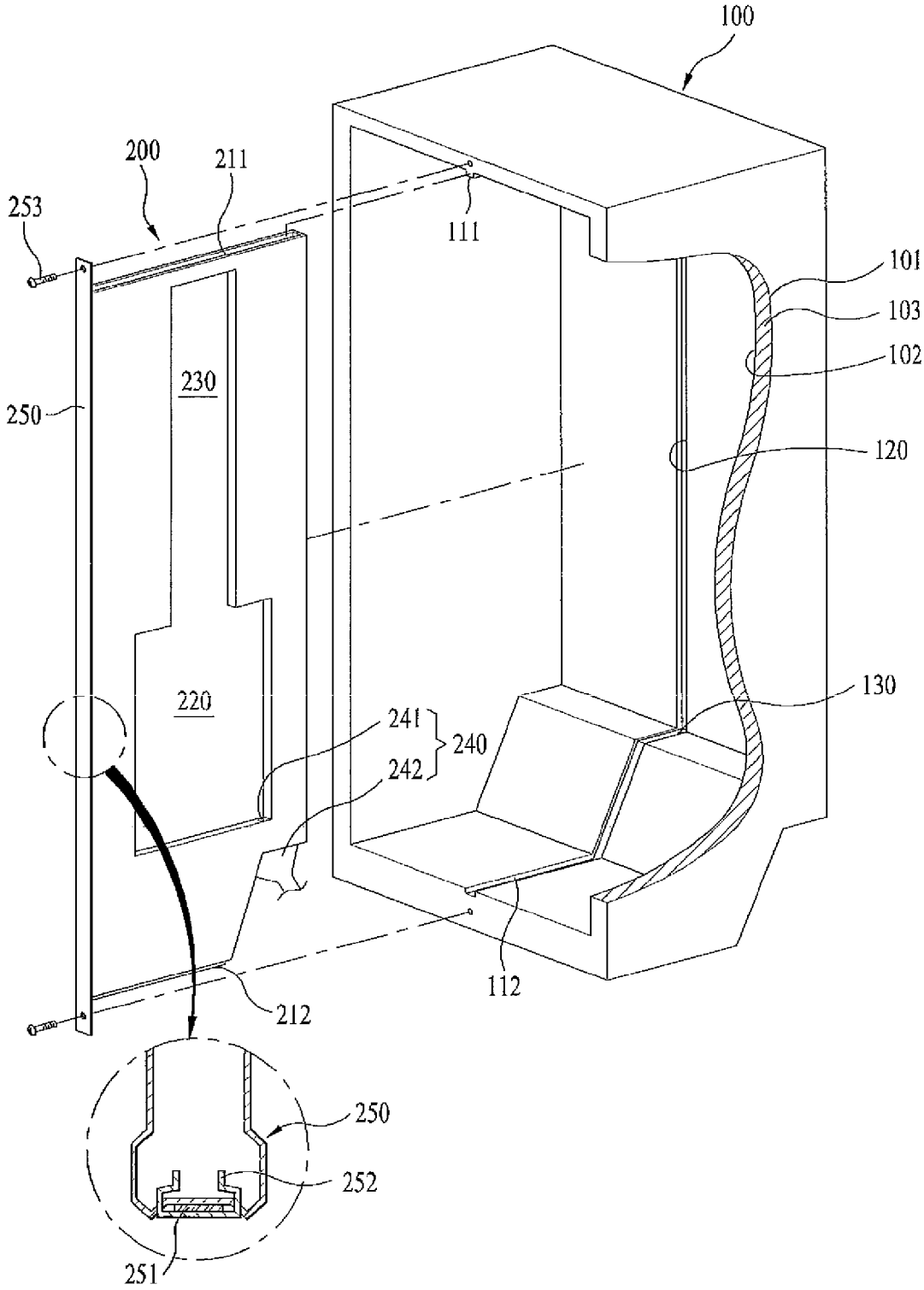
FIG. 1 illustrates an exploded perspective view of a refrigerator according to an embodiment of the present invention.

As shown in FIG. 1, a refrigerator according to an embodiment of the present invention includes a main body 100 having an inner space of a specified size and a plate 200 which is inserted into the main body 100 to divide the inner space into plural cooling chambers.

The main body 100 includes an outer case 101 and an inner case 102. A heat insulating material 103 is foamed and filled between the outer case 101 and the inner case 102. Further, a safe mounting portion 120 is formed on the inner case 102 such that the plate 200 is inserted and safely mounted on the main body 100.

Preferably, the safe mounting portion 120 is formed such that a rear end portion of the plate 200 is inserted into the safe mounting portion 120. As occasion demands, preferably, a member such as a gasket is interposed between the safe mounting portion 120 and the rear end portion of the plate 200 to insulate the respective cooling chambers defined by the plate 200 from each other.

Further, after the plate 200 is inserted into the main body 100 to be safely received in the safe mounting portion 120, an additional processing step may be performed such that a gap is not left between the rear end portion of the plate 200 and the safe mounting portion 120.

Meanwhile, formation portions 111 and 112 are disposed at an upper end and a lower end of an inner surface of the main body 100 to be engaged with an upper end and a lower end of the plate 200. In this instance, the formation portions having a same shape may be provided at the upper and lower ends of the inner surface of the main body 100, or the formation portions having different shapes may be provided at the upper and lower ends thereof.

In addition, in the embodiment shown in FIG. 1, the formation portion provided at the upper end of the inner surface of the main body 100 is referred to as a first formation portion 111, and the formation portion provided at the lower end of the inner surface of the main body 100 is referred to as a second formation portion 112. When the plate 200 is inserted into the main body 100, the upper end of the plate 200 is engaged with the first formation portion 111, and the lower end of the plate 200 is engaged with the second formation portion 112.

Further, when the first and second formation portions 111 and 112 are formed as grooves, the upper and lower ends of the plate 200 may be respectively inserted into the first formation portion 111 and the second formation portion 112.

Also, first and second coupling portions 211 and 212 may be formed at the upper and lower ends of the plate 200 to correspond to the first formation portion 111 and the second formation portion 112. For example, grooves may be formed as formation portions 111 and 112 and protrusions may be formed as coupling portions 211 and 212 to be engaged with the grooves.

The detailed description of the structure of the formation portions and the coupling portions will be described later.

Figure 2:
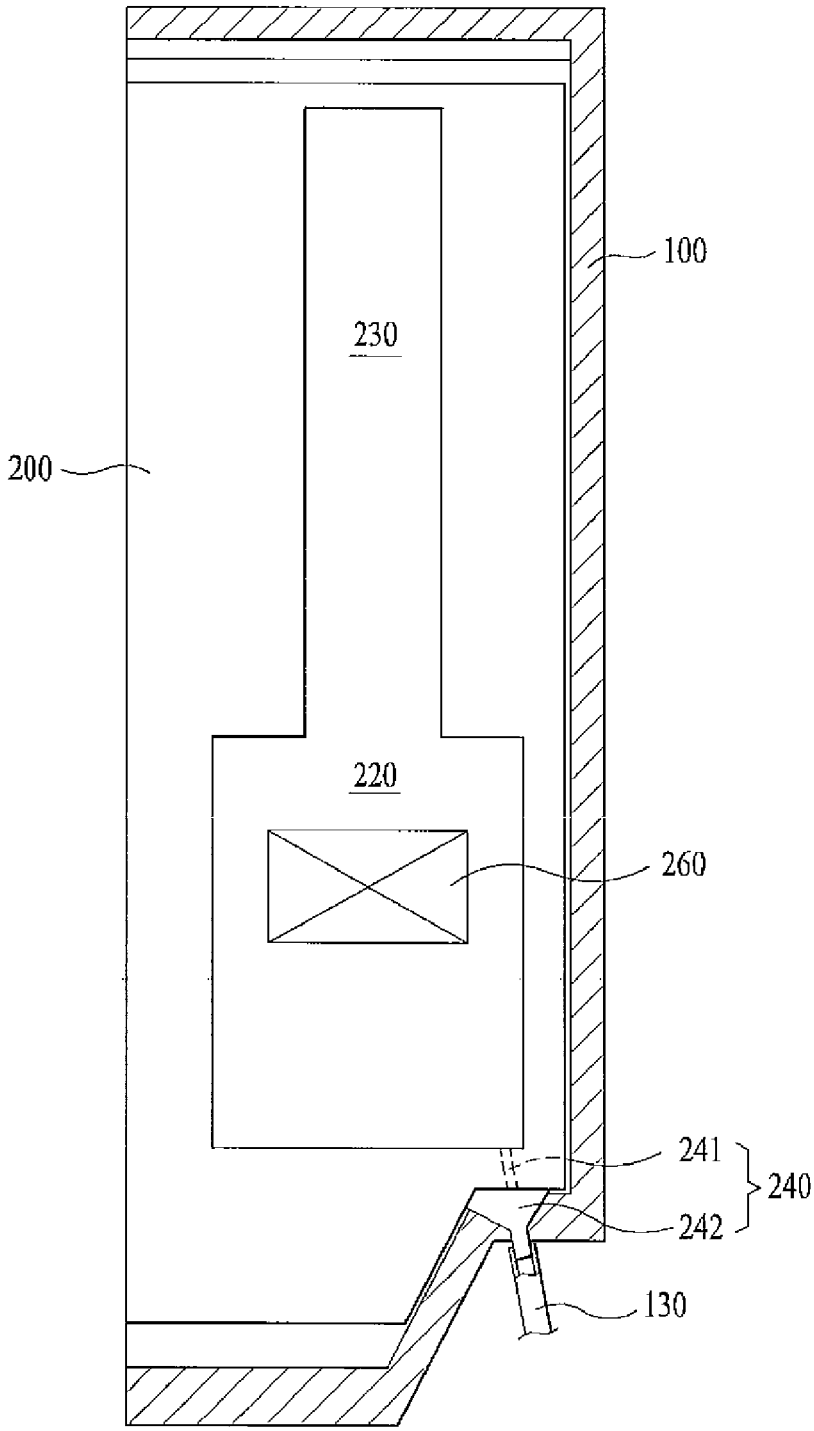
FIG. 2 illustrates a side cross-sectional view of the refrigerator according to an embodiment of the present invention.

Meanwhile, the refrigerator according to an embodiment of the present invention includes a cooling unit which cools at least one cooling chamber among the plural cooling chambers disposed on the plate 200. As shown in FIGS. 1 and 2, a recess portion 220 is recessedly formed on the plate 200 to install a cooling unit 260. Further, a duct portion 230 is recessedly formed on the plate 200 to flow cool air generated by the cooling unit 260.

In a manufacturing method of the refrigerator according to an embodiment of the present invention, the recess portion 220 and the duct portion 230 are formed on the plate 200, and then the plate 200 is inserted into the main body 100.

Accordingly, embodiments of the present invention advantageously enables the structure of the recess portion and the duct portion, which are very difficult to manufacture in the related art refrigerator. That is, a plate is formed on a main body as a single body from the beginning.

Meanwhile, as shown in FIGS. 1 and 2, a water drain unit 240 is disposed at one side of a lower end of the plate 200. The water drain unit 240 allows condensed water generated by defrosting of the cooling unit 260 to be collected and discharged at a lower end of the recess portion 220. Further, a water drain line 130 is disposed at one side of a lower end of the main body 100 to communicate with the water drain unit 240.

In addition, the water drain unit 240 includes a water drain hole 241 disposed at one side of a lower end of the recess portion 220 and a water drain guide 242, which is connected to the water drain hole 241, to guide the condensed water flowing through the water drain hole 241 to the water drain line 130.

Accordingly, when the plate 200 is inserted into the main body 100, the water drain guide 242 is inserted into the water drain line 130 such that the water drain hole 241, the water drain guide 242 and the water drain line 130 communicate with each other.

Further, as shown in FIG. 1, a front portion 250 of the plate 200 includes a heating portion 251 and a reinforcing portion 252. The heating portion 251 prevents a dew forming phenomenon at a front surface of the plate 200 due to a difference between a temperature of the cooling chambers and an external temperature. The reinforcing portion 252 reinforces a structural strength of the plate 200. In addition, the front portion 250 is fixed to the main body 100 by additional fixing parts 253 when the plate 200 is inserted into and fixed to the main body 100.

Now, embodiments of the present invention related to the structure of the formation portion of the main body and the coupling portion of the plate will be described with reference to FIGS. 3 to 6. Further, although the coupling structure of an upper end of the inner surface of the main body and an upper end of the plate is shown in FIGS. 3 to 6, a lower end of the inner surface of the main body and a lower end of the plate are coupled to each other in the same manner.

Figure 3:
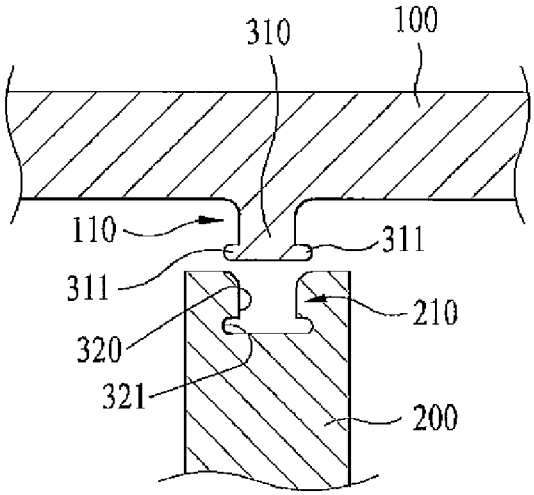
FIG. 3 is an overview illustrating a coupling structure of a main body and a plate applied to the refrigerator according to one embodiment of the present invention.

In the refrigerator shown in FIG. 3 according to one embodiment of the present invention, a formation portion 110 of the main body 100 includes a protruding portion 310. Also, coupling portion 210 of the plate 200 includes a groove 320 corresponding to the protruding portion 310. That is, the plate 200 is inserted into the main body 100 by engaging the protruding portion 310 with the groove 320.

As shown, the protruding portion 310 includes a flange 311 protruding by a predetermined length from a side surface of the protruding portion 310. Further, a flange groove 321 is formed on the groove 320 to be engaged with the flange 311. In addition, the flange 311 and the flange groove 321 serve to firmly couple the plate 200 to the main body 100 and maintain airtightness of the respective cooling chambers defined by the plate 200.

As occasion demands, in order to further ensure the airtightness of the respective cooling chambers, it is possible to use a material or member capable of being filled in a gap between the protruding portion 310 and the groove 320.

Figure 4:
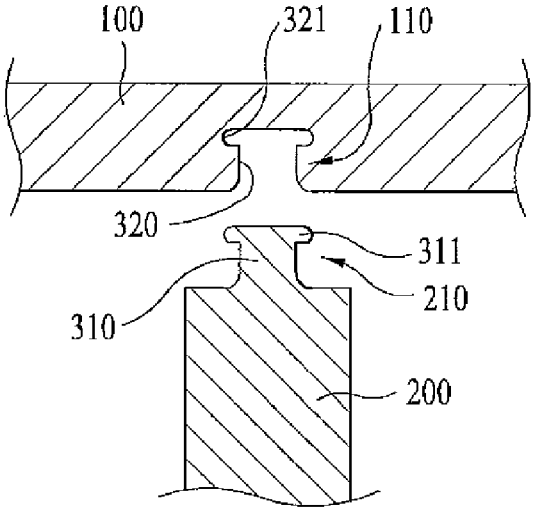
FIG. 4 is an overview illustrating a coupling structure of a main body and a plate applied to the refrigerator according to another embodiment of the present invention.

Meanwhile, in the refrigerator shown in FIG. 4 according to another embodiment of the present invention, the formation portion 110 of the main body 100 includes a groove 320. Further, a coupling portion 210 of the plate 200 includes the protruding portion 310 corresponding to the groove 320. That is, the plate 200 is inserted into the main body 100 by engaging the protruding portion 310 with the groove 320.

In addition, the protruding portion 310 includes a flange 311 protruding by a predetermined length from a side surface of the protruding portion 310. A flange groove 321 is formed on the groove 320 to be engaged with the flange 311. The flange 311 and the flange groove 321 serve to firmly couple the plate 200 to the main body 100 and maintain airtightness of the respective cooling chambers defined by the plate 200.

As discussed above, it is possible to use a material or member capable of being filled in a gap between the protruding portion 310 and the groove 320 to further ensure the airtightness of the respective cooling chambers.

Figure 5:
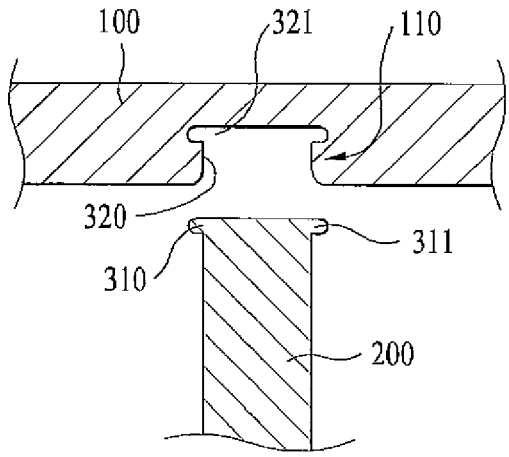
FIG. 5 is an overview illustrating a coupling structure of a main body and a plate applied to the refrigerator according to yet another embodiment of the present invention.

Meanwhile, in the refrigerator shown in FIG. 5 according to yet another embodiment of the present invention, a formation portion 110 of the main body 100 includes a groove 320. An upper end portion of the plate 200 is configured to be entirely coupled to the groove 320. That is, the plate 200 is inserted into and coupled to the main body 100 by inserting an upper end (or a lower end) of the plate 200 into the groove 320.

Further, a flange 311 is formed on an upper side surface of the plate 200, and a flange groove 321 is formed on the groove 320 to correspond to the flange 311. As discussed above, the flange 311 and the flange groove 321 serve to firmly couple the plate 200 to the main body 100 and maintain airtightness of the respective cooling chambers defined by the plate 200. Also, to further ensure the airtightness of the respective cooling chambers, it is possible to use a material or member capable of being filled in a gap between the protruding portion 310 and the groove 320.

Figure 6:
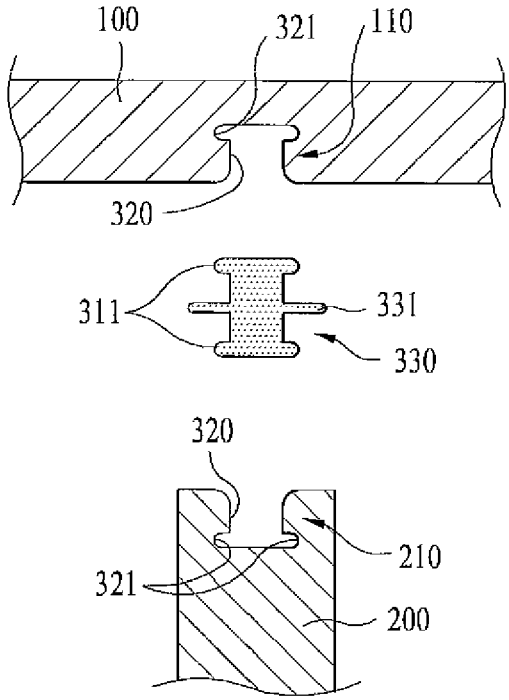
FIG. 6 is an overview illustrating a coupling structure of a main body and a plate applied to the refrigerator according to still another embodiment of the present invention.

Next, in the refrigerator shown in FIG. 6 according to yet another embodiment of the present invention, a formation portion 110 of the main body 100 and a coupling portion 210 of the plate 200 include grooves 320, respectively. Further, a packing member 330 is disposed between the grooves 320 and is coupled to the groove 320 formed on the main body 100 and the groove 320 formed on the plate 200.

A flange 311 is formed at a portion of the packing member 330, which is coupled to the groove 320 formed on the main body 100. Also, a flange 311 is formed at a portion of the packing member 330, which is coupled to the groove 320 formed on the plate 200.

Further, flange grooves 321 are formed on the grooves 320 to correspond to the flanges 311 disposed on the packing member 330, respectively. Thus, when the packing member 330 is coupled to the grooves 320, the flanges 311 are engaged with the flange grooves 321, thereby firmly coupling the plate 200 to the main body 100.

Preferably, the packing member 330 further includes a gasket portion 331 disposed between the main body 100 and the plate 200 in order to maintain airtightness of the respective cooling chambers defined by the plate 200.

Further, it is preferable to manufacture the packing member 330 using a material having a large elastic coefficient such as a rubber material. The portions of the packing member 330 corresponding to the grooves 320 are formed to have a size slightly larger than that of the grooves 320. Then, the packing member 330 is compressed and coupled to the grooves 320. Accordingly, because the packing member 330 is closely contacted to the inside of the grooves 320 with high elasticity when the packing member 330 is coupled to the grooves 320, it is preferable to maintain heat insulation of the respective cooling chambers.

Next, a method for manufacturing a refrigerator according to the embodiment of the present invention will be described with reference to FIGS. 1 and 2.

In the refrigerator according to embodiments of the present invention, first, the main body 100 and the plate 200 are manufactured separately. Then, the plate 200 is inserted into and coupled to the main body 100. That is, the method for manufacturing a refrigerator according to embodiments of the present invention includes a step of manufacturing a main body, a step of manufacturing a plate, and a step of inserting the plate into the main body to define respective cooling chambers.

Further, the step of manufacturing a main body includes a step of manufacturing a main frame, a step of forming a safe mounting portion, a step of forming formation portions, a step of forming a water drain line and the like. The respective steps are not necessarily performed in the described order and may be selectively performed regardless of the order.

In the step of manufacturing a main frame, an entire casing is manufactured as the outer case 101 and the inner case 102, and the heat insulating material 103 is foamed and filled between the outer case 101 and the inner case 102. Also, in the step of forming a safe mounting portion, a groove is formed such that the plate 200 is inserted and safely mounted on the main body 100.

In the step of forming formation portions, portions which guide the insertion of the plate 200 and are coupled to the plate 200 are formed on the main body 100. Since the formation portions are previously described, the detailed description thereof is omitted.

Further, in the step of forming a water drain line, the water drain line 130 is formed at one side of a lower end of an inner space of the main body 100. The water drain line 130 may be connected to a hose to discharge condensed water to the outside. The water drain line 130 may also be connected to a condensed water receiver (not shown) separately disposed at a lower end of the refrigerator such that the condensed water discharged along the water drain line is collected in the condensed water receiver.

Meanwhile, the step of manufacturing a plate includes a step of manufacturing a main frame, a step of forming a recess portion and a duct portion, a step of forming coupling portions, a step of forming a water drain unit and the like. The respective steps are not necessarily performed in the described order and may be selectively performed as occasion demands.

In the step of manufacturing a main frame, an entire casing is manufactured as the external case lot and the inner case 102, and the heat insulating material 103 is foamed and filled between the outer case 101 and the inner case 102. Also, the front portion 250 of the plate 200 is installed.

In the step of forming a recess portion and a duct portion, the specific structure of the recess portion 220 and the duct portion 230 is formed on one surface of the plate 200. In addition, prior to the step of manufacturing a main frame, the casing is processed to form specific configurations of the recess portion 220 and the duct portion 230.

In the step of forming coupling portions, coupling portions are formed at an upper end and a lower end of the plate to correspond to the formation portions formed at the step of manufacturing a main body. Since a configuration of the coupling portions is described previously, the detailed description thereof is omitted.

Further, the step of forming a water drain unit includes a step of forming the water drain hole 241 disposed at one side of a lower end of the recess portion 220 and a step of installing the water drain guide 242 at one side of a lower end of the plate 200 to communicate with the water drain hole 241. After performing the steps of manufacturing the main body 100 and the plate 200, the step of inserting the plate is performed to insert and fix the plate 200 to the main body 100.

In addition, the plate 200 is inserted into the main body 100 by engaging the coupling portions disposed at the upper and lower ends of the plate 200 with the formation portions disposed at the upper and lower ends of the main body 100.

While the plate 200 is inserted into the main body 100, the water drain unit 240 is made to communicate with the water drain line 130. After the plate 200 is inserted into the main body 100, the front portion 250 of the plate 200 is fixed to the main body 100.

Meanwhile, after the plate 200 is inserted into the main body 100, a step of filling gaps between the coupling portions of the plate 200 and the formation portions of the main body 100 may be additionally performed to ensure heat-insulating performance of the respective cooling chambers. For example, a material or member capable of being filled in the gap may be used.

When the above-mentioned manufacturing steps are completed, the other steps, for example, a step of installing a cooling unit and a step of installing a door, are performed, thereby completing the manufacture of the refrigerator.

The refrigerator and the method for the same according to embodiments of the present invention employ a novel type cooling chamber structure in which a cooling unit for cooling at least one cooling chamber among plural cooling chambers is disposed on one surface of a plate. Further, it is possible to easily form a complicated structure of the plate due to the cooling unit, thereby simplifying the operation and reducing the manufacturing cost and time.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for manufacturing a refrigerator, the method comprising:

manufacturing a main body which encloses a specified space and has an open front surface, the step of manufacturing the main body including:

providing a first formation portion at one side of an upper end of an inner surface of the main body; and providing a second formation portion at one side of a lower end of the inner surface of the main body;

manufacturing a plate having a specified thickness, the step of manufacturing the plate including:

forming a first coupling portion at the upper end of the plate to be coupled to the first formation portion; and forming a second coupling portion at the lower end of the plate to be coupled to the second formation portion; and manufacturing a packing member coupled to at least one of the formation portions and at least one of the coupling portions such that the plate is inserted into and fixed to the main body to pack the inner space divided by the plate; and coupling the plate with the main body by the packing member through one side of the open front surface of the main body to sectionalize the space provided in the main body.

2. The method according to claim 1, wherein the step of manufacturing the plate includes:

forming a space for mounting a cooling unit and a space for forming a cool air flow path on one surface of the plate.

3. The method according to claim 2, wherein the step of manufacturing the main body includes forming a water drain line at one side of an inner portion of the main body, the step of manufacturing the plate further includes providing a water drain unit at one side of a lower end of the plate to discharge defrosting water generated form the cooling unit, and the plate is inserted into the main body to connect the water drain unit to the water drain line in the step of inserting the plate.

4. The method according to claim 1, wherein the step of coupling the plate with the main body includes:

engaging the first formation portion with the first coupling portion by the packing member; and engaging the second formation portion with the second coupling portion by the packing member to slide and couple the plate.

5. A refrigerator, comprising:

a main body enclosing an inner space; and a plate inserted into the main body to divide the inner space into a plurality of cooling chambers, wherein the main body includes a formation portion disposed on at least one of one side of an upper end of an inner surface of the main body and one side of a lower end of the inner surface of the main body and configured to guide the plate into the main body and to couple the plate to the main body, and wherein the refrigerator further includes:

a coupling portion disposed on at least one of an upper end and a lower end of the plate and configured to correspond to the formation portion; and a packing member coupled to the formation portion and the coupling portion such that the plate is inserted into and fixed to the main body to pack the inner space divided by the plate.

6. The refrigerator according to claim 5, wherein the formation portion includes:

a first formation portion disposed at one side of the upper end of the inner surface of the main body and configured to be coupled to an upper end of the plate; and a second formation portion disposed at one side of the lower end of the inner surface of the main body and configured to be coupled to a lower end of the plate.

7. The refrigerator according to claim 6, wherein the plate includes:

a first coupling portion disposed at an upper end of the plate and configured to be coupled to the first formation portion; and a second coupling portion disposed at a lower end of the plate and configured to be coupled to the second formation portion.

8. The refrigerator according to claim 5, further comprising:

a flange formed on at least one of a portion of the packing member coupled to the formation portion and a portion of the packing member coupled to the coupling portion; and a flange groove formed on at least one of the formation portion and the coupling portion and configured to be engaged with the flange.

9. The refrigerator according to claim 5, further comprising:

a safe mounting portion formed on an inner surface of the main body such that the plate is inserted into the safe mounting portion and is mounted on the inner surface of the main body.

10. The refrigerator according to claim 5, further comprising:

a recess portion disposed on one surface of the plate;

a duct portion disposed on one surface of the plate and configured to communicate with the recess portion; and a cooling unit mounted on the recess portion.

11. The refrigerator according to claim 10, further comprising:

a water drain line disposed at one side of an inner portion of the main body; and a water drain unit arranged to communicate with the recess portion to discharge defrosting water generated form the cooling unit, the water drain unit being connected to the water drain line by inserting the plate.

12. The refrigerator according to claim 5, further comprising:

a reinforcing portion disposed on a front surface of the plate and configured to reinforce a strength of the plate; and fixing parts configured to fix the reinforcing portion to one side of an upper end of the main body and one side of a lower end of the main body, respectively.

13. The refrigerator according to claim 8, wherein the packing member further includes a gasket portion disposed between the main body and the plate in order to maintain airtightness of the respective cooling chambers defined by the plate.

* * * * *